United States Patent [19]

Aoki

[11] Patent Number: 4,579,333

[45] Date of Patent: Apr. 1, 1986

[54] UNIVERSAL PAPER FEED CASSETTE

[75] Inventor: Naoki Aoki, Hachioji, Japan

[73] Assignee: Konishiroku Photo Industry Co., Ltd., Tokyo, Japan

[21] Appl. No.: 525,935

[22] Filed: Aug. 24, 1983

[30] Foreign Application Priority Data

Aug. 31, 1982 [JP] Japan ..... 57-150146

[51] Int. Cl.[4] ..... B65H 1/04

[52] U.S. Cl. ..... 271/162; 271/164; 271/171; 355/8

[58] Field of Search ..... 271/171, 162, 164; 355/3 SH, 14 SH, 8

[56] References Cited

U.S. PATENT DOCUMENTS

| | | | |
|---|---|---|---|
| 3,592,464 | 7/1971 | Kanda | 271/223 |
| 4,211,482 | 7/1980 | Arai et al. | 355/8 |
| 4,236,808 | 12/1980 | Tusso et al. | 355/8 |
| 4,270,857 | 6/1981 | Komori et al. | 355/8 |
| 4,382,674 | 5/1983 | Miyoshi et al. | 271/171 |
| 4,456,366 | 6/1984 | Komiya et al. | 355/8 |

OTHER PUBLICATIONS

Xerox Disclosure Journal, "System for Automatically Adjustable Side Guides", Collins, Joseph, vol. 1, Nos. 9, 10, p. 41.

Colglazier, D. F. et al., "Paper Size Indication", IBM Technical Disclosure Bulletin, vol. 18, No. 7, Dec. 1975, p. 2057.

*Primary Examiner*—Bruce H. Stoner, Jr.
*Assistant Examiner*—James E. Barlow
*Attorney, Agent, or Firm*—James E. Nilles; Thomas F. Kirby

[57] ABSTRACT

A universal paper feed cassette wherein the position of a slidable guide plate for stopping the recording paper to be loaded is detected by a detecting device, so that the size of recording paper can be detected.

9 Claims, 6 Drawing Figures

UNIVERSAL PAPER FEED CASSETTE

BACKGROUND OF THE INVENTION

1. Field of the Invention

This invention relates to the construction of a universal paper feed cassette capable of detecting the size of recording paper housed therein, and improving the reproduction efficiency, i.e. recording efficiency.

2. Description of the Prior Art

Most of the picture recording apparati recently used, such as electrophotographic reproducing machines employ a system in which the recording paper is fed piece by piece from a cassette which houses a plurality of pieces of recording paper of a predetermined size and which is set in a predetermined position in a recording apparatus to record a picture thereon. Various cassettes according to the sizes of recording paper are provided, and they are replaced one by another every time recording paper of a different size is desired. In order to save the trouble of using different cassettes for recording paper of different sizes, a cassette capable of housing recording paper of many different sizes has been developed and put to practical use. Such a cassette is called a universal cassette and consists of a cassette body capable of housing recording paper of a maximum size, and slidable guide plates are provided in the cassette body and are adapted to stop one side edge and one end edge, i.e. a rear edge of the recording paper, the guide plates being manually moved by a user to be fixedly set. One of these guide plates, which is adapted to stop a side edge of recording paper, is called a side guide plate, and the other, which is adapted to stop an end edge, is called a rear end stopper.

Different cassettes housing therein recording paper of different sizes and used for a conventional picture recording apparatus are provided with cuts, which are formed to different shapes or in different positions in predetermined portions thereof, or with magnets attached to different positions on the rear sides thereof, so as to use different scanning distances of an optical scanning system for recording paper of different sizes. Specifically, when recording paper of a small size (for example, B5 size) is used, the optical scanning distance is shortened, and, when recording paper of a large size (for example, A3 size) is used, the optical scanning distance is lengthened. This prevents a useless operation of an optical scanning system, and allows the number of reproduced recording paper per unit time to increase greatly. Thus, the recording efficiency can be improved.

However, when a universal cassette is used in conventional recording apparatus, an optical scanning distance is determined in a fixed level irrespective of the size of the recording paper in use by the position of a magnet provided on the rear side of the cassette or the shape or position of a cut provided in a certain portion thereof. Therefore, both when recording paper of a small size is used, and, when recording paper of a large size is used, the numbers (so-called reproduction rates) of recording paper, which can be reproduced per unit time, become equal. In other words, when recording paper of a small size is used, the reproduction efficiency decreases.

SUMMARY OF THE INVENTION

An object of the present invention is to eliminate the drawbacks mentioned above and encountered in a conventional universal paper feed cassette of this kind, and provide a universal paper feed cassette capable of detecting the size of the recording paper housed therein, by utilizing the movements of guide plates for use in setting the recording paper in a predetermined position, to vary a scanning distance of an optical scanning system in accordance with the size of the recording paper in use. When recording paper of a small size is used in this universal paper feed cassette, the scanning distance of an optical scanning system becomes shorter than that in the case where recording paper of a large size is used therein. This prevents a useless scanning operation of the optical scanning system, and allows the reproduction efficiency to be improved.

The above and other objects as well as advantageous features of the invention will become apparent from the following description of the preferred embodiment taken in conjunction with the accompanying drawings.

DESCRIPTION OF THE PREFERRED EMBODIMENTS

Figure 1A:
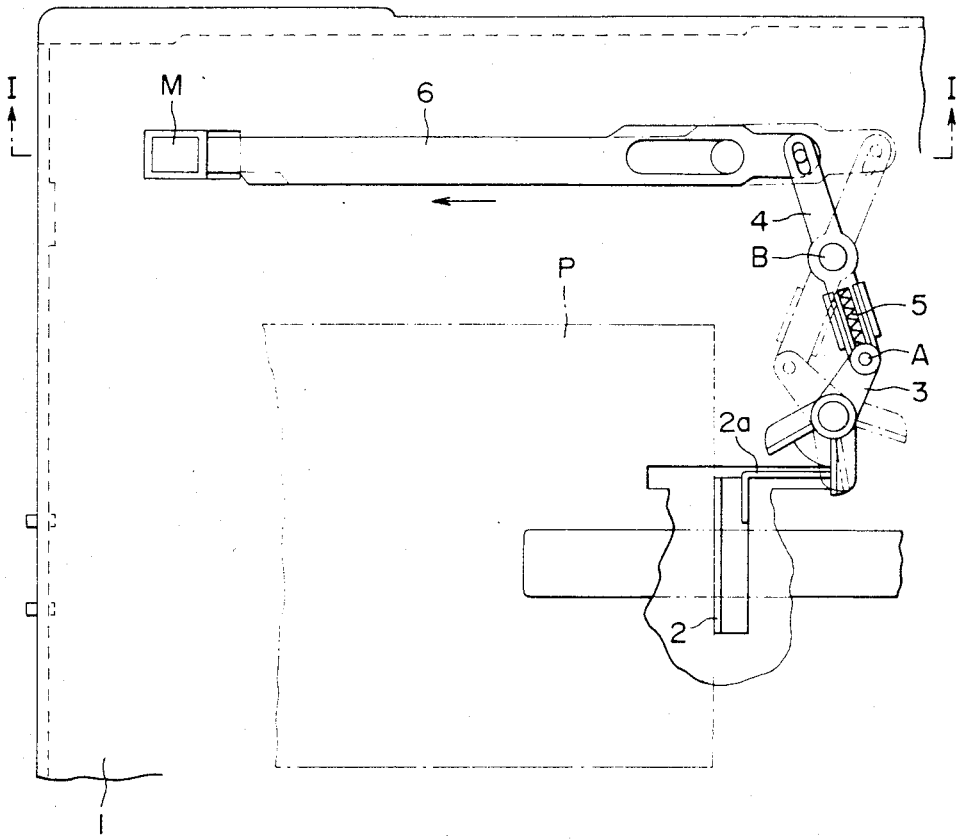
FIG. 1*a* is a bottom view of a means for detecting the size of recording paper for a universal paper feed cassette according to the present invention.

FIG. 1*a* shows an example of a means for detecting the size of recording paper, provided on the rear side of a universal paper feed cassette. Referring to the drawing, reference numeral 2 denotes a rear end stopper operated from the front side (i.e. the side, from which the recording paper is inserted) of a universal cassette body 1.

Figure 1B:
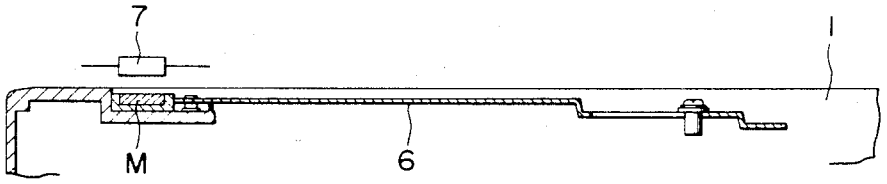
FIG. 1*b* is a sectional view taken along the line I—I in FIG. 1*a;*

The recording paper P of an arbitrary size is placed in a predetermined position in a universal cassette body 1. A side guide plate (not shown) is applied to a side edge of the recording paper P, and a rear end stopper 2 to a rear end thereof. As a result, one arm of a link 3 is pressed by a free end of a push rod 2*a* attached to the rear stopper 2, so that the link 3 is moved pivotally about a point A to take a position shown in the drawing, due to the force of a spring 5 provided between a connector plate 4 and the link 3. The connector plate 4 is turned counter-clockwise about a point B to displace a magnet-operating stay 6 in the leftward direction (the direction of an arrow). A magnet M is fixed to a free end (left end) of the magnet-operating stay 6. When the magnet has taken the very position shown in the drawing, a lead switch 7 (refer to FIG. 1*b*) provided above the magnet M is turned on. In this example, a position taken by the size detecting means when the rear end stopper 2 is moved with recording paper of another size placed in the cassette body 1 is shown in one-dot chain line. When the size detecting means is in this position, the magnet M is not in the position, in which the magnet M is opposed to the lead switch 7, and, accordingly, the lead switch 7 is off.

When the rear end stopper 2 is thus moved with respect to recording paper of different sizes, the lead switch 7 is turned on or off accordingly. Therefore, a scanning distance of an optical scanning system can be controlled on the basis of an electric signal from the lead switch by a control circuit in the recording apparatus.

Figure 2:
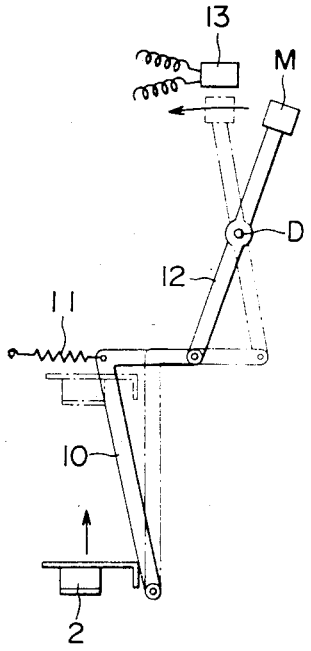
FIG. 2 is a schematic diagram of a principal portion of another example of the means for detecting the size of recording paper.

FIG. 2 shows another example of a means for detecting the size of recording paper.

When a rear end stopper 2 is moved in the direction of an arrow in accordance with the size of recording paper, a stopper guide stay 10 is turned clockwise about one end C thereof against a spring 11 to reach a position shown in one-dot chain line. Consequently, a magnet-operating stay 12 pivotably connected to the other end of the stopper guide stay 10 is turned about a fulcrum D in the direction of an arrow. When a magnet M is fixed to a free end of the magnet-operating stay 12, it is moved from a position shown in full line to a position shown in one-dot chain line in accordance with an operation of the rear end stopper 2. Accordingly, the size of the recording paper can be detected by a magnetic sensor 13 consisting of a lead switch provided in a position opposed to a position, to which the magnet M is displaced. A scanning distance of an optical scanning system is varied on the basis of a signal from the magnetic sensor 13 in the same manner as in the previously-described example.

Figure 3:
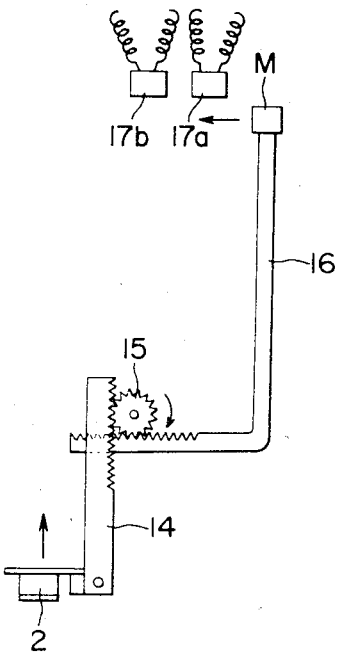
FIG. 3 is a schematic diagram of a principal portion of still another example of the means for detecting the size of recording paper.

FIG. 3 shows an example of a means for detecting the size of recording paper, using a rack and a pinion. When a rear end stopper 2 is operated, a rear end rack 14 is moved in the direction of an arrow, and a pinion 15 is turned in the direction of an arrow. As a result, a magnet stay 16 having a magnet M attached to a free end thereof is moved by a distance in accordance with an operational amount of the rear end stopper 2. Accordingly, when magnetic sensors 17*a*, 17*b* are provided in predetermined positions corresponding to the sizes of recording paper, the size of recording paper can be detected on the basis of an operation of the rear end stopper 2. A scanning distance of an optical scanning system can be varied by using electric signals from the magnetic sensors 17*a*, 17*b*.

Figure 4:
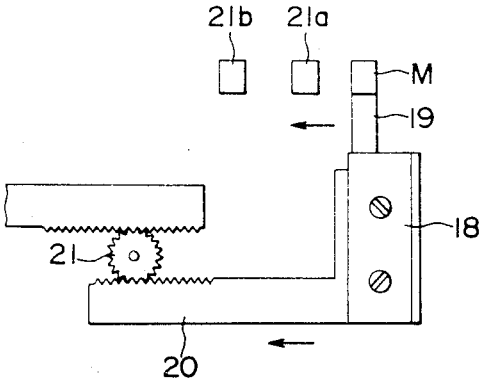
FIG. 4 is a schematic diagram of a further example of the means for detecting the size of recording paper by using a side guide plate.

FIG. 4 shows an example of a means for detecting the size of recording paper, having a simple construction and using a side guide plate 18 instead of a rear end stopper. A magnet M is fixed to a part of the side guide plate 18 via a support plate 19, and the side guide plate 18 and a rack 20 are joined to each other unitarily. When the side guide plate 18 is operated, the rack 20 and pinion 21 cooperate with each other, and the magnet M is moved in accordance with an amount of movement of the side guide plate 18. Therefore, when magnetic sensors 21*a*, 21*b* are provided in positions corresponding to the sizes of recording paper, in the same manner as in the example shown in FIG. 3, the size of the recording paper can be detected on the basis of the position of the side guide plate 18.

In the above example, a combination of a magnet and a magnetic sensor consisting of a lead switch is used as a means for detecting the size of recording paper. A size detecting means shown in FIG. 5 may also be employed, in which a projection is moved in accordance with an operational amount of a rear end stopper or a side guide plate as shown in FIG. 5, to turn on or off micro-switches provided in positions corresponding to the sizes of recording paper.

Figure 5:
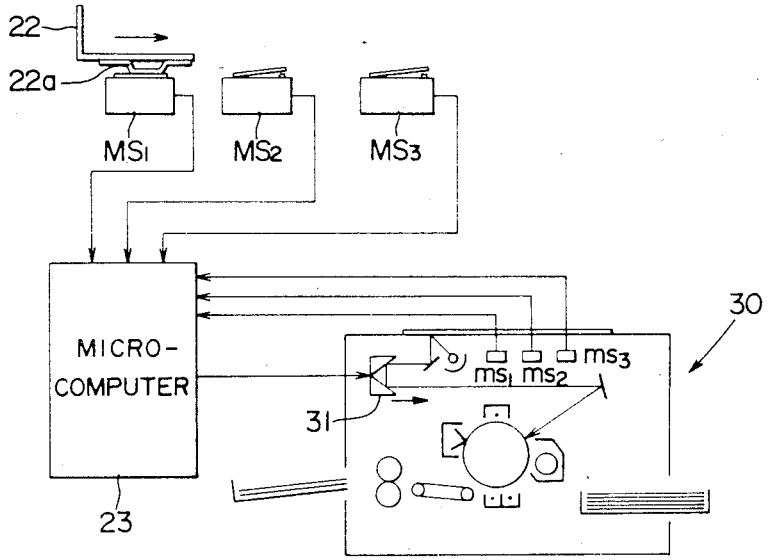
FIG. 5 is a schematic diagram of an example of the means for detecting the size of recording paper by using a micro-switch, and a scanning distance control circuit in an optical scanning system.

FIG. 5 shows a means for detecting the size of recording paper with a scanning distance control circuit in an optical scanning system. A projection 22*a* is formed on a lever 22. When a rear end stopper (not shown) is operated to cause the lever 22 to be moved in the direction of an arrow, micro-switches $MS_1$, $MS_2$, $MS_3$ provided in positions corresponding to the sizes of recording paper are turned on or off. A signal representative of the size of recording paper from the micro-switch $MS_1$, $MS_2$ or $MS_3$ is applied on a microcomputer 23. On the other hand, micro-switches $ms_1$, $ms_2$, $ms_3$ are provided along a scanning path of an optical scanning system 31 in a body of a recording apparatus 30. The positions of these micro-switches correspond to scanning distances of an optical scanning system for the sizes of various recording paper. When, for example, the micro-switch $MS_1$ (corresponding to the size of the smallest recording paper) is turned on after a rear end stopper in a universal cassette body has been operated, a reproduction operation starts with the optical scanning system 31 moved in the direction of an arrow. When the microswitch $ms_1$ is then turned on, a forwardly-moving clutch (not shown) in the optical scanning system 31 is deenergized in accordance with a judging operation of the microcomputer 23. Consequently, the forward movement of the optical scanning system 31 is stopped, and a backwardly-moving clutch is energized to start backwardly-moving.

When recording paper of another size is used, an optical scanning distance corresponding to the size is determined in the same manner as mentioned above. The size of recording paper may also be detected magnetically by moving a magnetic body instead of the magnet in the above example, which magnetic body is displaced in accordance with an operation of a rear end stopper or a side guide plate to be engaged with and disengaged from a magnet and thereby change the direction of the magnetic line of force. In the above-described examples, one cam means is employed, which is moved in accordance with an operation of a rear end stopper or a side guide plate. A plurality of cam means can also be used to vary the optical scanning distances correspondingly to all sizes of recording paper. The control method shown in FIG. 5 may be modified to a method utilizing encoder pulses possessed by a reproducing apparatus, in which method the number of encoder pulses is determined by a detection operation of a micro-switch $MS_1$, $MS_2$ or $MS_3$, to return an optical system.

When a reproduction operation is carried out by using a universal cassette according to the present invention described above, a scanning distance of an optical scanning system is varied in accordance with the movement of guide plates, which are used to set the recording paper in a cassette body. Accordingly, the optical scanning system is moved by a distance corresponding to the size of the recording paper. Namely, when recording paper of a small size is used, an optical scanning distance becomes small, so that the useless optical scanning can be prevented. This allows the number of pieces of reproduced paper per unit time to increase, and the reproduction efficiency to be improved.

What is claimed is:

1. A universal paper feed cassette characterized by comprising a rear end stopper movable so as to contact with the trailing edge of a recording paper to be loaded, an intermediate member pivotally supported so as to be rotated following the movement of said rear end stopper, and a lever member connected to one portion of said intermediate member and movable linearly in a direction along the side edge of said recording paper according to the rotation of said intermediate member, wherein a member to be detected by a detecting means provided in a body of a recording apparatus is mounted on a free end portion of said lever member.

2. The universal paper feed cassette according to claim 1, wherein said intermediate member comprises a connector plate (4) pivotally mounted so as to be connected at one end thereof with said lever member, and a pushing bar (3) pivotally supported so as to have one end united with a spring (5) and the other end contacting with said rear end stopper.

3. The universal paper feed cassette according to claim 1, further comprising a side guide plate provided movably so that it is brought into contact with the side edge of said recording paper.

4. The universal paper feed cassette according to claim 1, wherein said member to be detected is a magnet.

5. A universal paper feed cassette characterized by comprising a rear end stopper movable so as to contact with the trailing edge of a recording paper to be loaded, a connecting member pivotally supported so as to be rotated following the movement of said rear end stopper, a spring urging said rear end stopper in a moving direction of said rear end stopper, and a lever member connected to a free end portion of said connecting member, wherein a member to be detected by a detecting means provided in a body of a recording apparatus is mounted on a free end portion of said lever member.

6. The universal paper feed cassette according to claim 5, wherein said member to be detected is a magnet.

7. The universal paper feed cassette according to claim 5, further comprising a side guide plate provided movably so that it is brought into contact with the side edge of said recording paper.

8. The universal paper feed cassette according to claim 7, wherein said member to be detected is a magnet.

9. A universal paper feed cassette characterized by comprising a rear end stopper provided so as to contact with the trailing edge of a recording paper to be loaded, a member having a rack gear joined unitarily with said rear end stopper, a pinion gear meshing with said rack gear, and a lever mounted movably in a direction normal to a moving direction of said rear end plate through said pinion gear according to the movement of said rear end plate, wherein a member to be detected by a detecting means provided in a body of a recording apparatus is mounted on a free end portion of said lever member.

* * * * *